US010391027B1

(12) United States Patent
Pande

(10) Patent No.: US 10,391,027 B1
(45) Date of Patent: Aug. 27, 2019

(54) PILL ORGANIZER AND DISPENSER

(71) Applicant: James R. Pande, Jupiter, FL (US)

(72) Inventor: James R. Pande, Jupiter, FL (US)

( * ) Notice: Subject to any disclaimer, the term of this patent is extended or adjusted under 35 U.S.C. 154(b) by 449 days.

(21) Appl. No.: 15/354,586

(22) Filed: Nov. 17, 2016

Related U.S. Application Data

(60) Provisional application No. 62/256,522, filed on Nov. 17, 2015.

(51) Int. Cl.
*A61J 1/03* (2006.01)
*A61J 7/00* (2006.01)

(52) U.S. Cl.
CPC ..... *A61J 1/03* (2013.01); *A61J 7/0076* (2013.01)

(58) Field of Classification Search
CPC ..... B65D 83/04; B65D 83/0445; A61J 1/03; A61J 7/0076
USPC ..... 209/630, 702, 703, 706, 707
See application file for complete search history.

(56) References Cited

U.S. PATENT DOCUMENTS 3,262,747 A * 7/1966 Kotzek ..... A61J 7/0076 206/538
3,393,794 A * 7/1968 Borin ..... A61J 7/0076 206/539
3,545,164 A 12/1970 Middleton
4,126,247 A 11/1978 Majka
4,685,271 A * 8/1987 Ringer ..... A61J 7/02 53/246
4,817,819 A * 4/1989 Kelly ..... B65D 83/0463 116/308
4,872,559 A * 10/1989 Schoon ..... A61J 1/03 206/538
5,240,113 A * 8/1993 Gibilisco ..... A61J 1/03 206/534
5,737,902 A 4/1998 Alyward
5,797,248 A * 8/1998 Hetherington ..... A61J 3/075 141/247
5,829,632 A 11/1998 Gehlert
6,607,094 B2 8/2003 MacDonald
6,761,010 B1 7/2004 Gibson
6,779,663 B1 * 8/2004 Pocsi ..... A61J 1/03 141/242
7,334,699 B2 2/2008 Keffeler et al.
7,856,794 B2 * 12/2010 Zieher ..... B65B 5/103 53/246
7,950,202 B2 * 5/2011 Kodama ..... B65B 5/103 53/244
8,584,434 B2 * 11/2013 Kodama ..... B65B 5/103 53/235

(Continued)

*Primary Examiner* — Joseph C Rodriguez

(57) ABSTRACT

A pill organizer and dispenser or pill loader is provided and includes a housing having a plurality of openings formed through a top surface thereof. The openings are organized into a matrix of rows corresponding, for instance, to various times of an individual day and columns corresponding, for instance, to the seven days of the week. The pill loader further includes slides movably mounted within the housing and positioned beneath each of the rows. Each slide includes a segment having a solid portion blocking the opening in the housing and an open portion allowing a pill placed in the opening to fall through the opening and into a pill storage container. The slides are moveable in a lateral direction to present indicia within the openings and in a transverse direction to either block or allow a pill to pass through the openings.

20 Claims, 8 Drawing Sheets

(56) References Cited

U.S. PATENT DOCUMENTS

| | | | | |
|---|---|---|---|---|
| 9,355,222 | B2 * | 5/2016 | Chudy | G06F 19/3462 |
| 10,143,627 | B2 * | 12/2018 | Miceli | A61J 1/03 |
| 2005/0029156 | A1 | 2/2005 | Girzaitis | |
| 2005/0045519 | A1 | 3/2005 | Hirsch | |

* cited by examiner

PILL ORGANIZER AND DISPENSER

CROSS-REFERENCE TO RELATED APPLICATIONS

This application claims the benefit of U.S. Provisional Patent Application Ser. No. 62/256,522, filed Nov. 17, 2015, which is incorporated by reference herein in its entirety.

FIELD OF THE INVENTION

The present invention relates generally to pill organizers and dispensers and, more particularly, to a method and apparatus for depositing individual pills into a multi-period pill container.

BACKGROUND OF THE INVENTION

Many people need to take prescribed or recommended medication pills to correct or manage a variety of health conditions. The pills are typically taken on a consistent basis to be most effective. These pills often need be taken at prescribed intervals and times, such as once a day or multiple times a day and in the morning, noon, evening or at bed time. Keeping track of when a person has taken a particular pill can be difficult especially if multiple pills at multiple times of the day are required.

Numerous types of storage containers are available for assisting in organizing pills in order to ensure they are taken at the correct times and in the correct order. These containers are typically organized on a weekly or seven-compartment basis corresponding to the seven days of the week. More advanced types of storage containers may have multiple rows of compartments to account for individual times of a particular day. For example, a storage container may include four compartments corresponding to morning, noon, evening and bed times associated with an individual day. This gives twenty-eight compartments of pills to cover a full week and is a very effective way of keeping track of when or whether one has taken their pills properly and as prescribed.

Problems may arise, however, in initially filling or loading up the multiple storage compartments with the all the correct and differing pills. This is further complicated if different types of pills are to be taken with differing frequencies. Loading each compartment of a storage container with the correct pill is a time-consuming task. Further, ensuring that the correct pill gets placed in the correct storage compartment for the correct day or time of day can get confusing and is prone to mistakes. Should a person not take the correct pill at the correct time of day due to inaccuracies in initially filling their storage container, serious health complications may arise.

Accordingly, there is an established need for a method and device for sorting and depositing the pills into a multi-compartment storage container. There is also a need for a method and device for quickly and easily depositing multiple pills simultaneously into correct compartments corresponding to multiple dosage times for a particular day.

SUMMARY OF THE INVENTION

The present invention is directed to a pill sorting and organizing or pill loading device for selectively depositing pills within a pill storage container. The pill loading device is easy to use and allows for safe loading of a daily pill storage container with the correct pills without fear of filling the wrong storage compartments. The pill loading device includes a housing having a plurality of openings arranged in rows and columns. A sorting plate assembly is arranged beneath the openings, and is formed by slides that are laterally slidable relative to each other and are in vertical registration with the opening rows. The sorting plate assembly can be jointly translated rearward and forward, to open and close the openings in dependence of the lateral position of each slide.

In a first implementation of the invention, a pill loading device for positioning pills into a pill storage container includes a housing having an array of openings formed on a top wall of the housing. The array includes two or more rows of openings extending in a left-to-right, lateral direction of the housing and two or more columns of openings extending in a front-to-back, transverse direction of the housing. The housing defines a cavity beneath the array of openings. A user-operable sorting plate assembly is positioned beneath the array of openings and is carried by the housing in a transversely movable relationship with the housing. The sorting plate assembly is operable from outside the housing to move transversely relative to the housing. The sorting plate assembly includes two or more user-operable slides laterally movable relative to one another. Each slide is arranged under a respective row of the two or more rows of openings and extending across the respective row, and is operable from outside the housing to move transversely relative to the housing. Each slide includes a first portion having transversely interspersed and aligned solid portions and open portions. The solid portions and open portions are divided into at least two pairs of a solid portion and an open portion. Each slide is transversely movable to a first transverse position. In this first transverse position, the slide is laterally movable relative to the housing to adopt a position in which the solid portions of the slide are aligned with the openings of the respective row, preventing a pill from passing through the opening and into the cavity of the housing, and an alternative position in which the open portions of the slide are aligned with the openings of the respective row, allowing a pill to pass through the opening and into the cavity of the housing.

In a second aspect, the sorting plate assembly can further include a user-operable end portion protruding outwardly from a front of the housing.

In another aspect, the end portion can be slidably coupled to an adjacent slide of the two or more user-operable slides.

In another aspect, each slide can include a gripping portion at one or both lateral ends thereof, the griping portion extending outward from the housing.

In another aspect, each slide can further include a second portion transversely adjacent to the first portion, said second portion carrying indicia adjacent to each pair of a solid portion and an open portion. The sorting plate assembly can be transversely movable from the first transverse position to a second transverse position. In this second transverse position, each slide is laterally movable relative to the housing to adopt two alternative lateral positions. In at least one of these two alternative lateral positions, the indicia are at least partially visible through the openings of the respective row and informative of whether the open portions or the solid portions of the slide are transversely aligned with said openings.

In yet another aspect, quadrants of said second portion which are transversely aligned with the open portions and solid portions of the first portion of the slide are can be solid.

In another aspect, the sorting plate assembly can be spring biased in the transverse direction towards the second transverse position.

In another aspect, the indicia can include at least two pairs of a first indicia and a second indicia. Each pair is arranged in transverse alignment with a respective pair of a solid portion and an open portion, and the first indicia is transversely aligned with the solid portion while the second indicia is transversely aligned with the open portion. In other words, both the open portions and the solid portions can be provided with a respective, different indicia or visible marking.

In another aspect, the second portion of each slide can be arranged rearward to the first portion of said each slide. Thus, the sorting plate assembly is moved transversely rearward in order to allow pills to fall into the cavity.

In another aspect, the array of openings can consist of four rows of openings. Optionally, visible markings can be provided on the top wall of the housing, each marking arranged at or proximate a row of openings and indicative of a different time of a day. Alternatively or additionally, the array of openings can consist of seven columns of openings. Visible markings can optionally be included on the top wall of the housing, each marking arranged at or proximate a column of openings and indicative of a different day of a week.

In another aspect, the housing can further include a respective drop tube extending downward from each opening into the cavity of the housing.

In yet another aspect, the pill loading device can include a storage container comprising a plurality of compartments and configured to fit within the cavity of the housing such that each compartment is positioned beneath a respective opening of the array of openings of the housing.

In another aspect, a pill cutter cup can be provided on a top surface of the top wall of the housing. The pill cutter cup can include a sidewall extending from the top surface and including an opening, and a cutter bar movably mounted to the sidewall.

In another aspect, a pill overflow cup can be provided on a top surface of the top wall of the housing. The pill overflow cup can include a sidewall extending from the top surface and including an opening, and a discharge chute extending outward from the sidewall and beyond a side of the housing.

In yet another aspect, the pill loading device can further include a pull-out drawer movable relative to the housing. The pull-out drawer can adopt a pulled-out position in which the discharge chute of the pill overflow cup is directed toward an inner compartment of the pull-out drawer.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
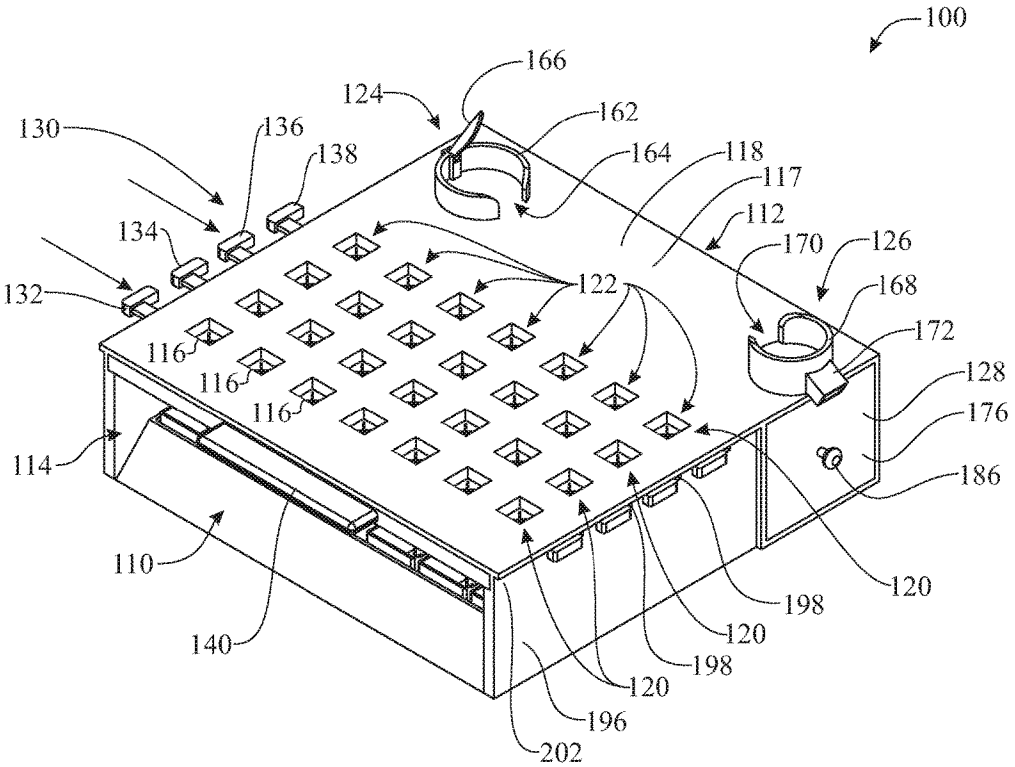
FIG. 1 presents a top front, right side isometric view of a pill organizer and dispenser device of the present invention including an installed pill storage container.
Figure 2:
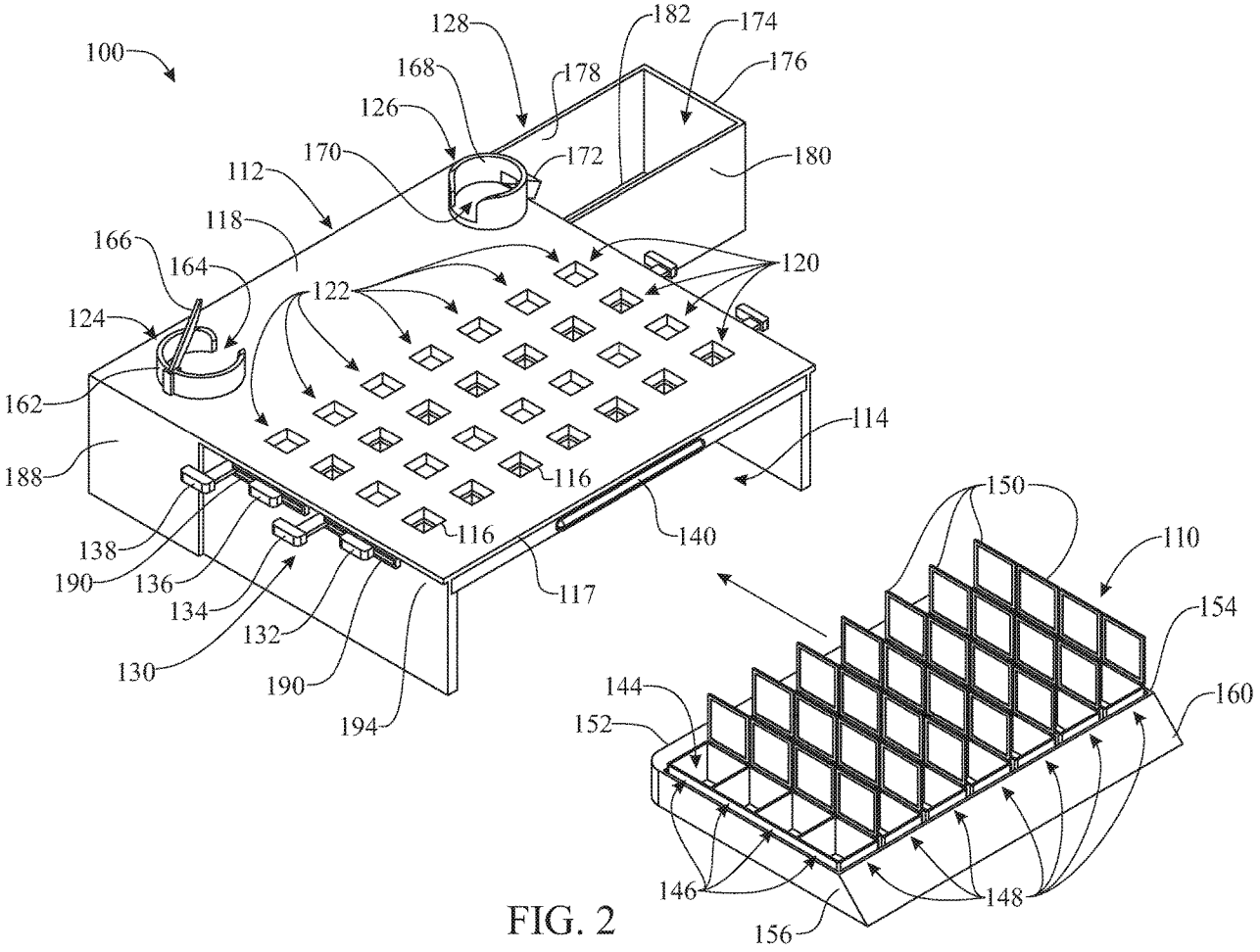
FIG. 2 presents a top front, left side isometric view of the pill organizer and dispenser device with the pill storage container removed and a storage drawer of the device pulled out.
Figure 3:
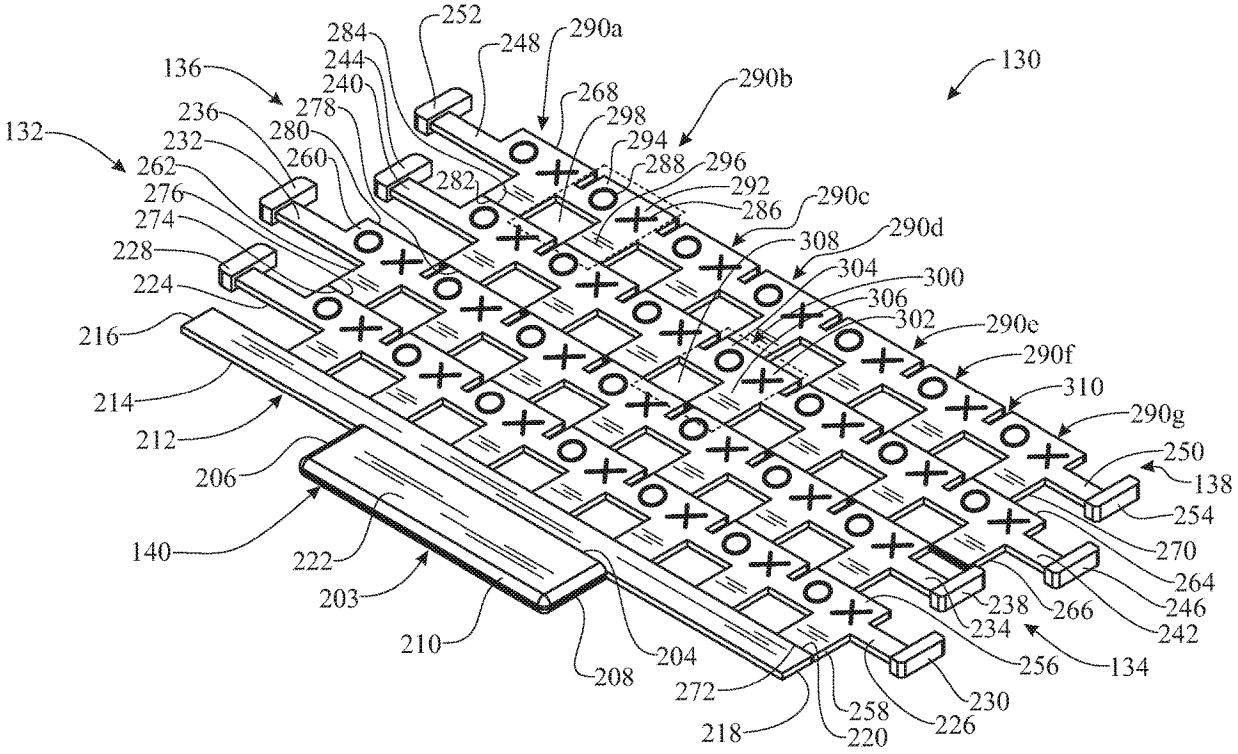
FIG. 3 presents a top front, right side isometric view of a sorting plate assembly of the pill organizer and dispenser device.

Referring to FIGS. 1-3, and initially with regard to FIGS. 1 and 2, a medical pill organizer and dispensing device or pill loader 100 is illustrated in accordance with an exemplary embodiment of the present invention. The pill loader 100 is provided to facilitate organizing medical pills according to days and times of day and to deposit multiple pills simultaneously into the correct compartments of a multi-compartment pill storage container 110.

The pill loader 100 generally includes a housing 112 having a front opening 114 for receipt of the pill storage container 110. A plurality of passages or openings 116 are formed through a top wall 117 of the housing 112 and function as temporary storage areas for pills to be deposited into the pill storage container 110 and as passageways for the pills to pass through and into the pill storage container 110.

The openings 116 are arranged in a matrix of rows 120 extending sideways across the top wall 117 of the housing 112 and columns 122 extending from front to back of the top wall 117 of the housing 112 in manner described in more detail hereinbelow.

The pill loader 100 can include a pill cutter cup 124 and a pill overflow cup 126 positioned on a top surface 118 of the top wall 117 of the housing 112. The pill cutter cup 124 is provided to cut or break apart pills into partial pills according to a particular prescribed dosage, such as prior to moving the pill or partial pills into one or more of the openings 116. The pill loader 100 additionally includes a pull-out drawer 128 for storage of excess pills. The pill overflow cup 126 provides a space to collect excess pills deposited on the top surface 118 of the housing 112 and move them into the pull-out drawer 128 for storage.

With continued reference to FIGS. 1 and 2, the pill cutter cup 124, positioned on the top surface 118 of the housing 112 of the pill loader 100, includes a circular sidewall 162 having an opening 164 extending from the top surface 118. Pills may be deposited on the top surface 118 and moved across the top surface 118 and into the pill cutter cup 124, through the opening 164, by use of a tool or a finger of the user. A cutter bar 166 is movably (e.g. pivotably) mounted to the sidewall 162 to cut pills for adjusting a particular dosage or pill size.

When excess pills are present on the top surface 118 of the housing 112, the pills may be moved across the top surface 118 into the pill overflow cup 126 for deposition into the pull-out drawer 128 for storage. The pill overflow cup 126 includes a circular sidewall 168 having an opening 170 extending from the top surface 118. A discharge chute 172 is provided and extends outward from the sidewall 168 and beyond a side of the housing 112. The discharge chute 172 can be directed toward an inner compartment 174 of the pull-out drawer 128 when the pull-out drawer 128 is in an open position, i.e. pulled out from the side of the housing 128 (FIG. 2). The discharge chute 172 is provided to transfer the pills between the pill overflow cup 126 back into the original prescription pill container (which may be placed inside the pull-out drawer 128 with the pull-out drawer 128 in the open position, or simply placed next to the housing 112 with the pull-out drawer 128 in the closed position).

As best shown in FIG. 2, the inner compartment 174 of the pull-out drawer 128 is defined by an outer wall 176, side walls 178 and 180, a bottom 182 and a back or inner wall 184 (FIG. 5) of the pull-out drawer 128. As best shown in FIG. 1, a pull handle 186 is provided on the outer wall 176 and assists a user in sliding the pull-out drawer 128 in and out of the housing 112.

In order to programmably control which pills fall through specific openings 116 in housing 112 and into the pill storage container 110, the pill loader 100 includes a sorting plate assembly 130 (FIG. 3) which is movably mounted within the housing 112 beneath the top surface 118 of the housing 112. The sorting plate assembly 130 is movable in both the lateral or side-to-side direction and in the transverse or front-to-back direction within the housing 112. As best shown in FIG. 3, the sorting plate assembly 130 generally includes a first slide 132, a second slide 134, a third slide 136 and a fourth slide 138 which are connected together. The sorting plate assembly additionally includes a user-operable end portion 140 connected to the first slide 132. The first, second, third and fourth slides 132, 134, 136 and 138 are independently and slidably movable relative to each other in a sideways or lateral fashion; in turn, the first slide 132 and user-operable end portion 140 are also slidably movable relative to one another in the lateral or side-to-side direction. In addition, the first, second, third and fourth slides 132, 134, 136 and 138 and the user-operable end portion 140 can be jointly moved front to back within the housing 112 in the transverse, front-to-back direction by the user exerting a transverse force on the user-operable end portion 140. The lateral, side-to-side positioning of each individual first, second, third and fourth slides 132, 134, 136 and 138 within the housing 112 determines which rows 120 of openings 116 will allow pills to fall into the pill storage container 110. In turn, transverse or front-to-back operation of the user-operable end portion 140 causes the pills to actually fall into the pill storage container 110 in a manner described in more detail hereinbelow.

Referring specifically to FIG. 2, the pill storage container 110 depicted herein is of a conventional type typically available in pharmaceutical stores. The pill storage container 110 generally includes a storage container body 142 having a plurality of storage compartments 144 formed therein. The storage compartments 144 are arranged into four rows 146 and seven columns 148 which correspond to four times of day for taking pills and the seven days of the week. Each storage compartment 144 includes a movable lid 150 to secure the pills within the pill storage container 110. The storage container body 142 generally includes a rear 152, a right side 154, a left side 156, a bottom 158 and a tapered front side or edge 160. The user can push or pull the tapered front side or edge 160 of the storage container body 142 to facilitate insertion and removal of the pill storage container 110 into and out of the pill loader 100.

In order to move the sorting plate assembly 130 sideways and from front to back within the housing 112, the housing 112 includes a left side wall 188 having four slide slots 190 along an upper edge 194 of the left side wall 188 (FIG. 2). Likewise, the housing 112 additionally includes a right side wall 196 having four slide slots 198 along an upper edge 202 of the right side wall 196 (FIG. 1). The first, second, third and fourth slides 132, 134, 136 and 138 are positioned through the slide slots 190 and 198. While the present embodiment includes four side slots 190, 198 on each one of the left side wall 188 and the right side wall 196, alternative embodiments are contemplated in which the housing 112 can include any number of slots from one to four on each none of the left side wall 188 and the right side wall 196 allowing front-to-back sliding of the first, second, third and fourth slides 132, 134, 136 and 138.

Turning now to FIG. 3, the details of the sorting plate assembly 130, including the first, second, third and fourth slides 132, 134, 136 and 138, respectively, along with the user-operable end portion 140, will now be described. As noted above, the user-operable end portion 140 is provided to allow the user to move or slide the entire sorting plate assembly 130 transversely front to back and back to front within the housing 112 of the pill loader 100. The user-operable end portion 140 comprises a relatively shorter end section 203 and a relatively longer cross bar 212. The end section 203 has a back edge 204, side edges 206 and 208 and a front edge 210, and is affixed to the cross bar 212, which is in turn connected to and spans the width of the first slide 132. The cross bar 212 has a front edge 214, side edges 216 and 218 and a back edge 220. The front edge 214 of the cross bar 212 is affixed to the back edge 204 of the end section 203 so that the two move together; alternatively, the end section 203 and the cross bar 212 may be formed integrally with each other. An upper surface 222 of the end section 203 may be provided with indicia (not shown) to assist a user in operating the pill loader 100; for example, indicia such as, "in" and "out", "load" and "dispense", "push to dispense", etc.

As mentioned heretofore, each of the four slides, the first slide 132, the second slide 134, the third slide 136 and the fourth slide 138, are moveable in a sideways or lateral direction relative to each other and to the housing 112. Additionally, the first slide 132 is further movable sideways relative to the user-operable end portion 140. To assist the user in moving the slides, each slide includes a pair of gripping or grasping portions positioned at opposed ends of the slide and extending outward from the housing 112. Specifically, the first slide 132 includes left and right or first and second pulls 224 and 226 which terminate in respective enlarged buttons or tabs 228 and 230 to facilitate grasping the first and second pulls 224 and/or 226 by the user. Similarly, the second slide 134 includes opposed first and second pulls 232 and 234 terminating in enlarged buttons or tabs 236 and 238. The third slide 136 includes opposed first and second pulls 240 and 242 terminating in enlarged buttons or tabs 244 and 246 and the fourth slide 138 includes opposed first and second pulls 248 and 250 terminating in enlarged buttons or tabs 252 and 254. By grasping a pull or tab, for example first pull 224 or second pull 226 of first slide 132, the respective slide may be laterally pushed in or drawn out a side of the housing 212 to move the slide beneath the top surface 118 of the housing 112 and beneath the openings 116 (FIG. 1).

As best shown in FIG. 3, each slide includes an elongated back section, strip or portion spanning the width of the slide and visible through the openings 116 in the housing 112 when the sorting plate assembly 130 is in a forward position in the housing 112 and a front section, strip or portion visible through the openings 116 when the sorting plate assembly 130 is pushed back within the housing 112. More specifically, the first slide 132 includes a rigid, elongated back portion 256 extending between the pulls 224 and 226 of the first slide 132 and a front portion 258 extending forward from the back portion 256. Likewise, the second slide 134 includes a back portion 260 extending between pulls 232, 234 and a front portion 262. The third and fourth slides 136 and 138 include similar back portions 264 and 268 extending between pulls 240, 242 and 248, 250 and front portions 266 and 270, respectively.

As noted hereinabove, the disclosed slides are movable or slidable sideways relative to each other and to the housing 112, and the first slide 132 is also slidable sideways relative to the user-operable end portion 140. A front edge 272 of the front portion 258 of the first slide 132 is slidably connected to the back edge 220 of the cross bar 212 of the user-operable end portion 140. In addition, a front edge 274 of the front portion 262 of the second slide 134 is slidably connected to a back edge 276 of the back portion 256 of the first slide 232. Similarly, a front edge 278 of the front portion 266 of the third slide 136 is connected to a back edge 280 of the back portion 260 of the second slide 134. Finally, a front edge 282 of the front portion 270 of the fourth slide 138 is slidably connected to a back edge 284 of the back portion 264 of the third slide 136.

These slidable connections between the front and back edges of the respective front and back portions of the slides, and the back edge 220 of the cross bar 212 of the user-operable end portion 140, may be in the form of dovetailed connections, tongue and groove connections, extending ball and corresponding longitudinal circular grooves, etc. or other known methods of slidably interconnecting two adjacent longitudinal edges.

Each of the back portions includes indicia 286 and 288, visible through the openings 116 in the housing 112, to indicate to a user whether a pill placed in the corresponding opening 116 will be dispensed into the pill storage container 110 or not. The indicia may take a variety of forms and, in this embodiment, the indicia 286 and 288 take the form of adjacent "X"'s and "O"'s, respectively. Each pair of an adjacent X and O corresponds to a specific opening 116, in dependence of the lateral position of the corresponding slide, the X's and O's will alternately be visible through the specific opening 116. The O indicates that a pill placed within the specific opening 116 will subsequently drop into the pill storage container 110, whereas the X indicates that a pill placed within the specific opening 116 will not drop into the pill storage container 110. Each of the front portions includes a corresponding solid section and an open section. The solid sections are positioned in front of the X's while the open sections are positioned in front of the O's.

As noted above, the four slides, including the first slide 132, the second slide 134, the third slide 136 and the fourth slide 138, correspond to four designated time periods of a single day, for example morning, noon, evening and bed time. Further, each of the four slides, including the first slide 132, the second slide 134, the third slide 136 and the fourth slide 138, has seven segments which correspond to the seven days of the week. Each segment includes parts of both the front portion 270 and the back portion 268. Each segment includes a pair of an X and an adjacent O.

The following discussion is given with respect to the fourth slide 138 but is equally applicable to identical, corresponding portions, segments, indicia and open and solid sections of the other slides including the first slide 132, the second slide 134 and the third slide 136. The fourth slide includes seven segments 290*a-g* corresponding to the seven days of the week. The following discussion will be further given with regard to an individual segment, for example segment 290*b* corresponding to the second day of the week or Monday. Segment 290*b* has four quadrants, namely, a first quadrant 292 and a second quadrant 294 on the back portion 268 and a third quadrant 296 and a fourth quadrant 298 on the front portion 270 of the fourth slide 138. The first quadrant 292, the second quadrant 294 and the third quadrant 296 are solid sections of the fourth slide 138 while the fourth quadrant 298 defines an open space through which a pill can pass. The first quadrant 292 and the second quadrant 294 are laterally aligned with one another. The third quadrant 296 and the fourth quadrant 298 are laterally aligned with one another. The first quadrant 292 and third quadrant 296 are transversely aligned with one another. The second quadrant 294 and the fourth quadrant 298 are transversely aligned with one another.

As shown, the indicia 286 or X is positioned on the first quadrant 292 and the indicia 288 or O is positioned on the second quadrant 294, both of which are on the back portion 268. When the sorting plate assembly 130 is in a forward position within the housing 112 of the pill loader 100, the first and second quadrants 292 and 294 are lateral alignment with a corresponding opening 116 in the top surface 118 of the housing 112; in turn, when the sorting plate assembly 130 is moved to a back or rearward position by the user pushing the user-operable end portion 140, the third and fourth quadrants 296 and 298 are in lateral alignment with the corresponding opening 116.

Figure 4:
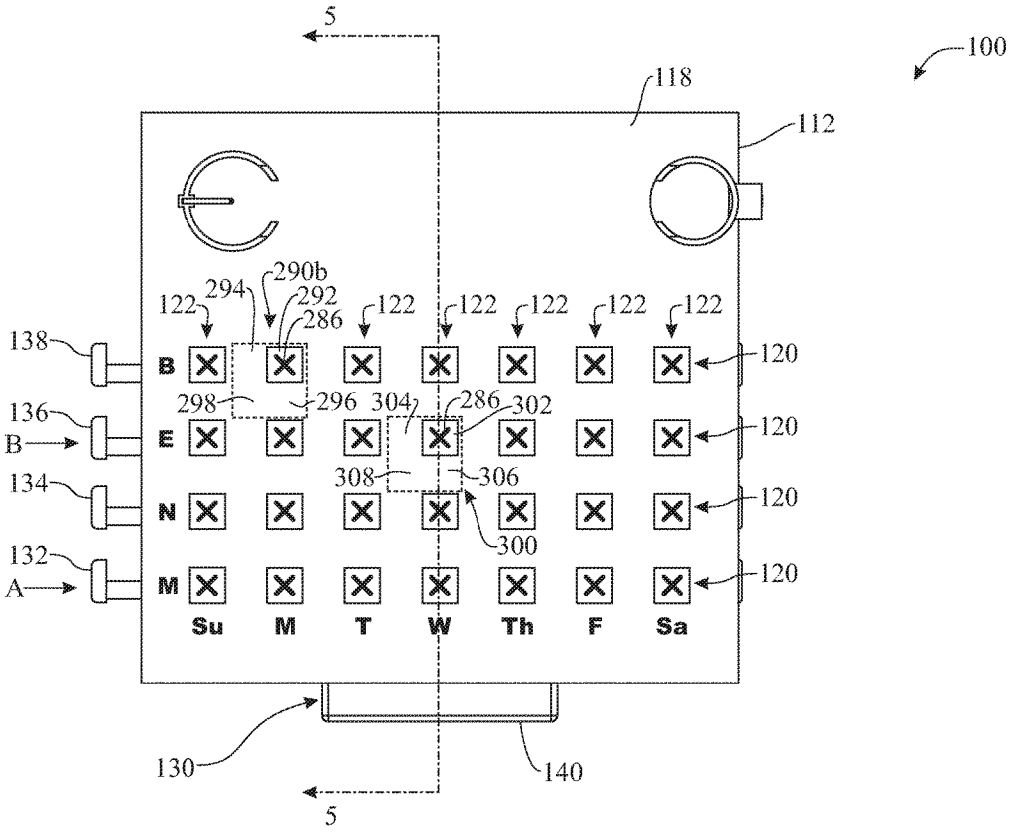
FIG. 4 presents a top plan view of the pill organizer and dispenser device with slides of the sorting plate assembly in a first position and a user-operable end portion of the sorting plate assembly pulled out in a first or loading position.

Referring now to FIGS. 3-8, and initially with regard to FIGS. 3 and 4, the operation of the pill loader 100 to sort and deposit specific pills into the pill storage container 110 will now be described. With reference for the moment to FIG. 3, an additional segment 300 will be described to further assist in illustrating the operation of the pill loader 100. The segment 300 is located on the third slide 136 and corresponds to the fourth day of the week or Wednesday. The segment 300 includes a solid first quadrant 302, a solid second quadrant 304, a solid third quadrant 306 and an open fourth quadrant 308. The segment 300 is identical to the segment 290*b* including indicia 286 and 288. It should be noted that the individual segments 290*a*, 290*b*, etc. may be separated from each other by notches 310 cut in the respective back portion, for example back portion 268.

Referring now to FIG. 4, in the initial position, the sorting plate assembly 130 is in a forward position within the housing 112 and all four slides, including the first slide 132, the second slide 134, the third slide 136 and the fourth slide 138, are in the leftmost position. With the sorting plate assembly in the forward position, the back portions of all the slides are in lateral alignment with the openings 116 in the top surface 118 of the housing 112. This places the pill loader 100 in a condition to be programmed and accept pills for dispensing to the pill storage container 110.

With reference to the segment 290*b* on the fourth slide 138 and the segment 300 on the third slide 136, it can be seen that with the slides in the leftmost position, the indicia 286 or "X" is visible through the openings 116 in the housing 112. It should be noted that all the openings 116 form a matrix of openings corresponding to the days of the week in the columns 122 and the four times of day as described above in rows 120. In this initial position, all the openings 116 will show or reveal the underlying indicia 286 or "X". It should be remembered at this point, that the indicia 286 or "X" in the first quadrant of any segment lies transversely behind the solid third quadrant and thus when the user-operable end portion 140 moves the sorting plate assembly 130 transversely rearward, a solid quadrant is still present beneath the opening 116 and no pill can pass through and into the pill storage container 110. Thus, the "X" indicates to the user that pills placed in these openings 116 will not fall into the pill storage container 110.

As shown, the four rows 120 may designate particular time periods of the day and may be represented by indicia in the form of Morning "M" aligned with the first slide 132, Noon "N" aligned with the second slide 134, Evening "E"" aligned with the third slide 136 and Bedtime "B" aligned with the fourth slide 138. These are typical dosage times prescribed by doctors. Additionally, the seven columns 122 may include indicia indicating the days of the week as follows: Sunday "Su", Monday "M", Tuesday "T", Wednesday "W", Thursday "T", Friday "F" and Saturday "Sa" as is conventional.

Figure 5:
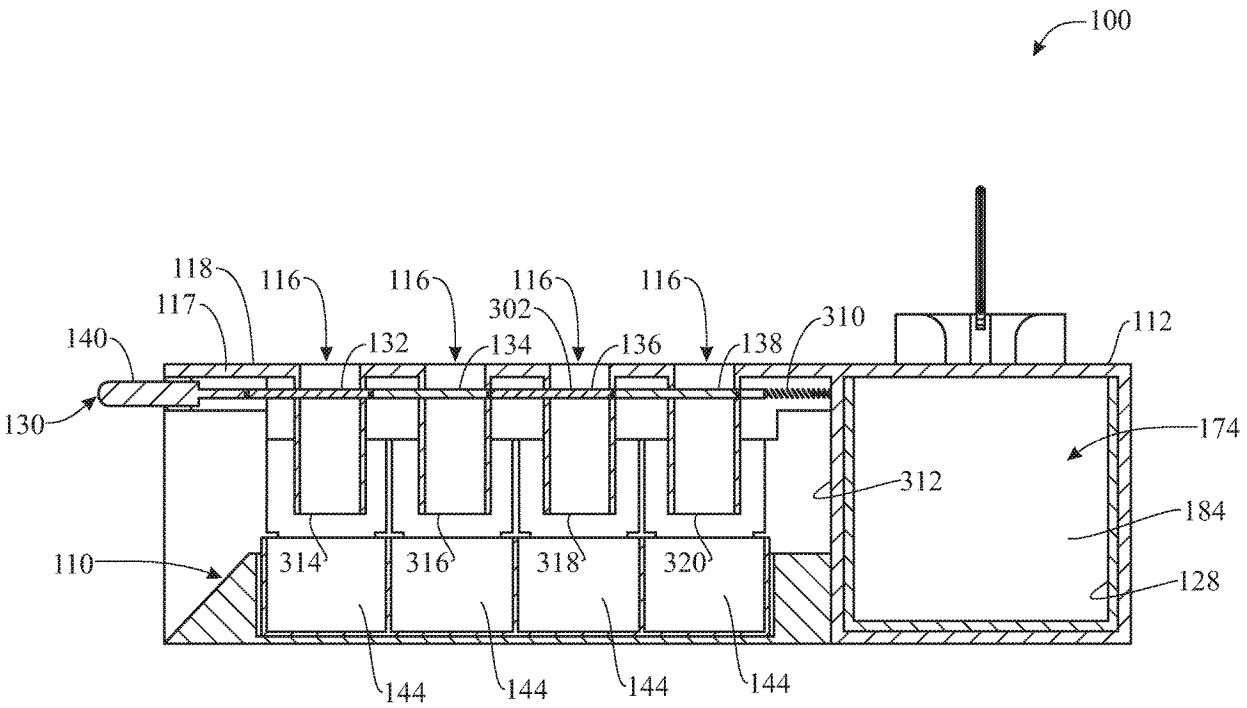
FIG. 5 presents a side elevation view, show in section, taken along section plane 5-5 indicated in FIG. 4.

Turning now to FIG. 5, in the initial position, the sorting plate assembly 130 is in the initial or transverse forward position within the housing 110. The solid portions of the first and second quadrants, for example the solid first quadrant 302 of the segment 300 in the third slide 136 blocks passage of any pill deposited in the opening 116 above. The sorting plate assembly 130 is biased to the initial position by one or more springs 310 positioned between the back edge 268 of the fourth slide 138 and an inner wall 312 of the housing 112. The pill storage container 110 has been inserted into the pill loader 100 for filling. As further shown, a series or four rows of drop tubes 314, 316, 318 and 320 extend downward from the openings 116 and exit into the pill storage compartments 144 in the pill storage container 110.

Figure 6:
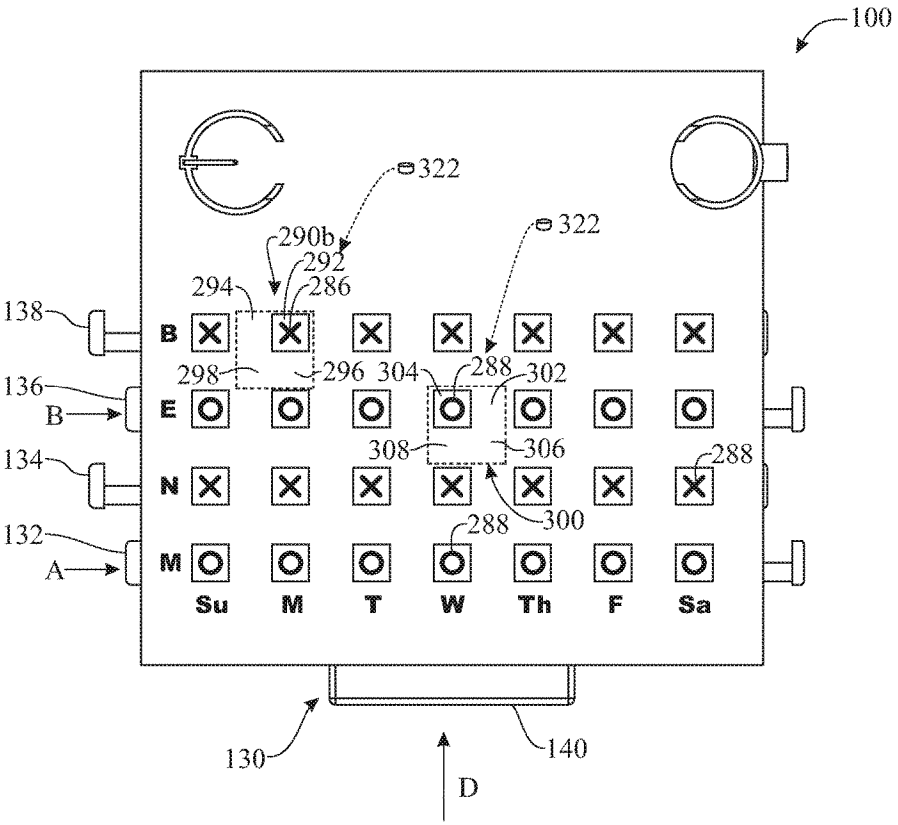
FIG. 6 presents a top plan view of the pill organizer and dispenser device with the first and third slides of the sorting plate assembly moved from a first position to a second position.

With regard to FIGS. 4 and 6, an example programming of the pill loader is shown. In this situation, the user desires to load pills to be taken in the morning and evening into the pill storage container for all days of the week. To accomplish this, the first and third slides 132 and 136, corresponding to the marked morning "M" and evening "E" are pushed laterally in the direction of arrows A and B (FIG. 4) from the left position to the right position within the housing 112. As shown in FIG. 6, this places the second quadrants of the first and third slides 132 and 134, for example the second quadrant 304 of the segment 300, beneath the respective morning "M" and evening "E" openings 116 to reveal the indicia 288 or "O"'s contained there on. In this manner, the user knows that when the user-operable end portion 140 is pushed, the respective fourth quadrant 308, defining the open space, will align vertically with the opening 116 and allow a pill placed thereon to drop into the pill storage container 110. In other words, the user knows that when the user-operable portion 140 is pushed, pills placed on the "O" marks will be dispensed into the pill storage container 110.

Pills 322 may now be placed on the openings 116 with the "O" showing. Should pills 322 be inadvertently left or placed in the openings 116 with the indicia 286 or "X"'s, for example in segment 290*b*, the user knows that on activation, the fourth solid quadrants will prevent any pills 322 from dropping into the pill storage container 110.

Figure 7:
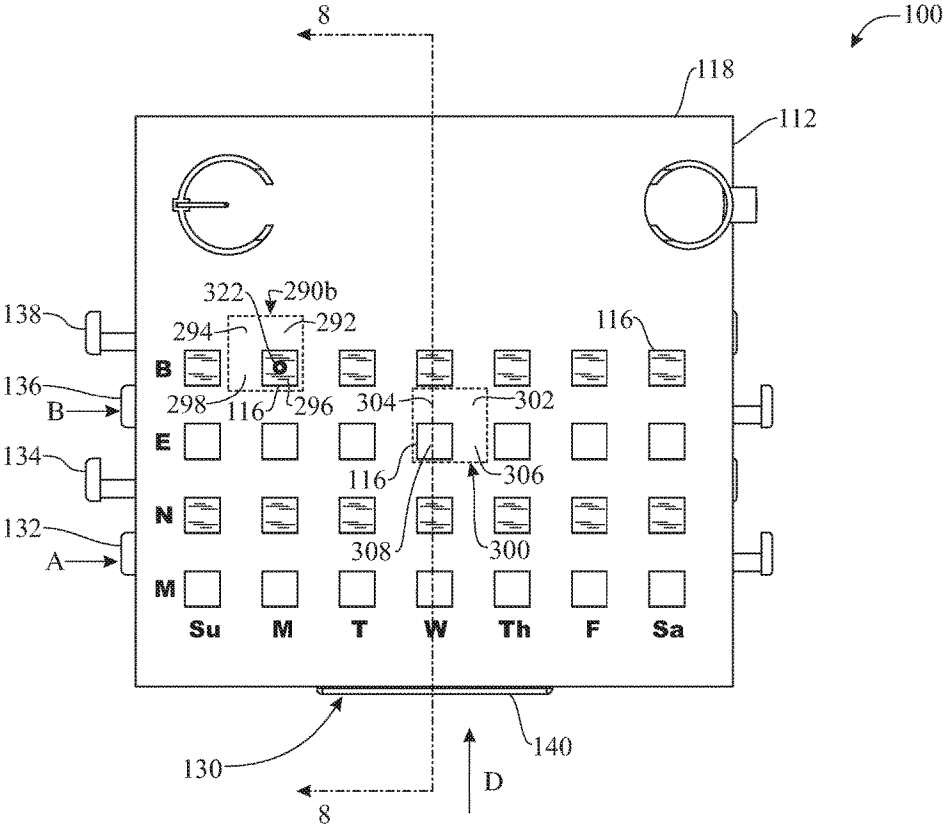
FIG. 7 presents a top plan view of the pill organizer and dispenser device similar to FIG. 6 with the user-operable end portion of the sorting plate assembly pushed inward relative to a housing of the pill organizer and dispenser device to a second or dispensing position.

Referring now to FIGS. 6 and 7, once all the pills 322 have been placed in a desired number of openings 116 indicated by "O"'s, the user-operable end portion 140 is pressed transversely rearward (i.e. inward) with respect to the housing 112 and against the bias of the springs 310 to slide the entire sorting plate assembly 130 rearward within the housing 112 in the direction of arrow "D" (FIG. 6). Moving the sorting plate assembly 130 rearward moves the solid back portions of the slides 132, 134, 136 and 138 out of alignment with the openings 116 and brings the front portions of the slides 132, 134, 136 and 138 into alignment with the openings 116. As noted above, the front portions contain the solid third and open fourth quadrants, for example the solid third quadrant 296 of the segment 290*b* on the fourth slide 138 and the open fourth quadrant 308 of the segment 300 on the third slide 136. Because the third quadrant 296 is solid any pill 322 placed in the corresponding opening 116 will not pass through into the pill storage container 110 (FIGS. 7 and 8).

Figure 8:
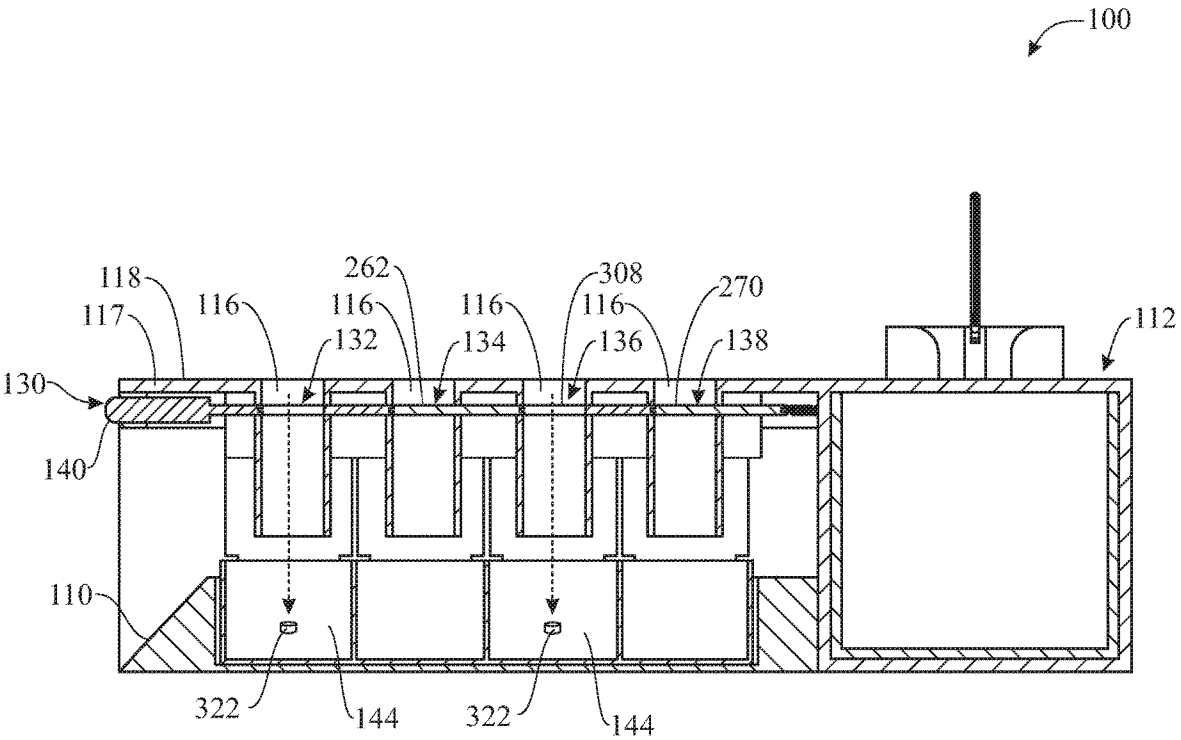
FIG. 8 presents a side elevation view, shown in section, taken along section plane 8-8 indicated in FIG. 7.

With continued reference to FIGS. 7 and 8, all the pills 322 placed in the openings 116 for the morning, i.e. first slide 132 and the evening, i.e. third slide 136, now have the open fourth quadrants of the slide beneath them and thus fall into the respective pill storage compartments 144 of the pill storage container 110. For example, the pill 322 deposited within the opening 116 along the third slide 136 and corresponding to the segment 300 falls through the open fourth quadrant 308 and into a respective pill storage compartment 144. As shown in FIG. 8, the openings 116 along the first and third slides 132 and 136 are clear through to the underlying pill storage compartments 114 while the openings 116 above the second and fourth slides 134 and 138 remain blocked by the respective solid portions of the front portions 262 and 270 of the second and fourth slides 134, 138, respectively In this manner, the disclosed pill loader provides a novel, easy-to-use and safe means of pre-loading a daily pill storage container with the correct pills without fear of filling the wrong storage compartments.

Since many modifications, variations, and changes in detail can be made to the described preferred embodiments of the invention, it is intended that all matters in the foregoing description and shown in the accompanying drawings be interpreted as illustrative and not in a limiting sense.

Thus, the scope of the invention should be determined by the appended claims and their legal equivalents.

What is claimed is:

1. A pill loading device for positioning pills into a pill storage container, comprising:

a housing having an array of openings formed on a top wall of the housing, the array comprising two or more rows of openings extending in a left-to-right, lateral direction of the housing and two or more columns of openings extending in a front-to-back, transverse direction of the housing, the housing defining a cavity beneath the array of openings;

a user-operable sorting plate assembly, positioned beneath the array of openings and carried by the housing in a transversely movable relationship with the housing, the sorting plate assembly operable from outside the housing to move transversely relative to the housing, the sorting plate assembly comprising two or more user-operable slides laterally movable relative to one another; wherein each slide is arranged under a respective row of the two or more rows of openings and extending across the respective row, and is operable from outside the housing to move transversely relative to the housing, and further wherein each slide comprises a first portion having transversely interspersed and aligned solid portions and open portions, said solid portions and open portions divided into at least two pairs of a solid portion and an open portion, wherein each slide is transversely movable to a first transverse position in which the slide is laterally movable relative to the housing to adopt:

a position in which the solid portions of the slide are aligned with the openings of the respective row, preventing a pill from passing through the opening and into the cavity of the housing, and an alternative position in which the open portions of the slide are aligned with the openings of the respective row, allowing a pill to pass through the opening and into the cavity of the housing.

2. The pill loading device of claim 1, wherein the sorting plate assembly further comprises a user-operable end portion protruding outwardly from a front of the housing.

3. The pill loading device of claim 2, wherein the end portion is slidably coupled to an adjacent slide of the two or more user-operable slides.

4. The pill loading device of claim 1, wherein each slide comprises a gripping portion at one or both lateral ends thereof, the griping portion extending outward from the housing.

5. The pill loading device of claim 1, wherein each slide further comprises a second portion transversely adjacent to the first portion, said second portion carrying indicia adjacent to each pair of a solid portion and an open portion, and further wherein the sorting plate assembly is transversely movable from the first transverse position to a second transverse position in which each slide is laterally movable relative to the housing to adopt two alternative lateral positions, wherein, in at least one of the two alternative lateral positions, the indicia is at least partially visible through the openings of the respective row and informative of whether the open portions or the solid portions of the slide are transversely aligned with said openings.

6. The pill loading device of claim 5, wherein quadrants of said second portion which are transversely aligned with the open portions and solid portions of the first portion of the slide are solid.

7. The pill loading device of claim 6, wherein the sorting plate assembly is spring biased in the transverse direction towards the second transverse position.

8. The pill loading device of claim 5, wherein said indicia comprises at least two pairs of a first indicia and a second indicia, each pair arranged in transverse alignment with a respective pair of a solid portion and an open portion, the first indicia transversely aligned with the solid portion and the second indicia transversely aligned with the open portion.

9. The pill loading device of claim 5, wherein the second portion of each slide is arranged rearward to the first portion of said each slide.

10. The pill loading device of claim 1, wherein the array of openings consists of four rows of openings.

11. The pill loading device of claim 10, further comprising visible markings on the top wall of the housing, each marking arranged at or proximate a row of openings and indicative of a different time of a day.

12. The pill loading device of claim 1, wherein the array of openings consists of seven columns of openings.

13. The pill loading device of claim 12, further comprising visible markings on the top wall of the housing, each marking arranged at or proximate a column of openings and indicative of a different day of a week.

14. The pill loading device of claim 1, the housing further comprising a respective drop tube extending downward from each opening into the cavity of the housing.

15. The pill loading device of claim 1, further comprising a storage container comprising a plurality of compartments and configured to fit within the cavity of the housing such that each compartment is positioned beneath a respective opening of the array of openings of the housing.

16. The pill loading device of claim 1, further comprising a pill cutter cup on a top surface of the top wall of the housing, the pill cutter cup comprising a sidewall extending from the top surface and including an opening, the pill cutter cup further comprising a cutter bar movably mounted to the sidewall of the pill cutter cup.

17. The pill loading device of claim 1, further comprising a pill overflow cup on a top surface of the top wall of the housing, the pill overflow cup comprising a sidewall extending from the top surface and including an opening, the pill overflow cup further comprising a discharge chute extending outward from the sidewall and beyond a side of the housing.

18. The pill loading device of claim 17, further comprising a pull-out drawer movable relative to the housing and configured to adopt a pulled-out position in which the discharge chute of the pill overflow cup is directed toward an inner compartment of the pull-out drawer.

19. A pill loading device for positioning pills into a pill storage container, comprising:

a housing having an array of openings formed on a top wall of the housing, the array comprising two or more rows of openings extending in a left-to-right, lateral direction of the housing and two or more columns of openings extending in a front-to-back, transverse direction of the housing, the housing defining a cavity beneath the array of openings;

a user-operable sorting plate assembly, positioned beneath the array of openings and carried by the housing in a transversely movable relationship with the housing, the sorting plate assembly operable from outside the housing to move transversely relative to the housing from a first transverse position to a second transverse position, the sorting plate assembly comprising two or more user-operable slides laterally movable relative to one another; wherein each slide is arranged under a respective row of the two or more rows of openings and extending across the respective row, and is operable from outside the housing to move transversely relative to the housing, and further wherein each slide comprises a first portion and a second portion transversely adjacent to the first portion, the first portion including transversely interspersed and aligned solid portions and open portions, said solid portions and open portions divided into at least two pairs of a solid portion and an open portion, and the second portion carrying indicia adjacent to each pair of a solid portion and an open portion; wherein when the sorting plate assembly is arranged in the first transverse position, the slide is laterally movable relative to the housing to adopt:

a position in which the solid portions of the slide are aligned with the openings of the respective row, preventing a pill from passing through the opening and into the cavity of the housing, and an alternative position in which the open portions of the slide are aligned with the openings of the respective row, allowing a pill to pass through the opening and into the cavity of the housing; and further wherein when the sorting plate assembly is arranged in the second transverse position, the slide is laterally movable relative to the housing to adopt two alternative lateral positions, wherein, in at least one of the two alternative lateral positions, the indicia is at least partially visible through the openings of the respective row and informative of whether the open portions or the solid portions of the slide are transversely aligned with said openings.

20. A pill loading device for positioning pills into a pill storage container, comprising:

a housing having an array of openings formed on a top wall of the housing, the array comprising two or more rows of openings extending in a left-to-right, lateral direction of the housing and two or more columns of openings extending in a front-to-back, transverse direction of the housing, the housing defining a cavity beneath the array of openings;

a user-operable sorting plate assembly, positioned beneath the array of openings and carried by the housing in a transversely movable relationship with the housing, the sorting plate assembly operable from outside the housing to move transversely relative to the housing from a first transverse position to a second transverse position, the sorting plate assembly comprising two or more user-operable slides laterally movable relative to one another and a user-operable end portion protruding outwardly from a front of the housing; wherein each slide is arranged under a respective row of the two or more rows of openings and extending across the respective row, and comprises a gripping portion at one or both lateral ends of the slide, the griping portion extending outward from the housing and operable from outside the housing to move the slide transversely relative to the housing, and further wherein each slide comprises a first portion and a second portion transversely adjacent to the first portion, the first portion including transversely interspersed and aligned solid portions and open portions, said solid portions and open portions divided into at least two pairs of a solid portion and an open portion, and the second portion carrying indicia adjacent to each pair of a solid portion and an open portion; wherein when the sorting plate assembly is arranged in the first transverse position, the slide is laterally movable relative to the housing to adopt:

a position in which the solid portions of the slide are aligned with the openings of the respective row, preventing a pill from passing through the opening and into the cavity of the housing, and an alternative position in which the open portions of the slide are aligned with the openings of the respective row, allowing a pill to pass through the opening and into the cavity of the housing; and further wherein when the sorting plate assembly is arranged in the second transverse position, the slide is laterally movable relative to the housing to adopt two alternative lateral positions, wherein, in at least one of the two alternative lateral positions, the indicia is at least partially visible through the openings of the respective row and informative of whether the open portions or the solid portions of the slide are transversely aligned with said openings.

* * * * *